US007802775B2

(12) United States Patent
Emilsen et al.

(10) Patent No.: US 7,802,775 B2
(45) Date of Patent: Sep. 28, 2010

(54) METHOD AND APPARATUS FOR MIXING OF TWO FLUIDS

(75) Inventors: Morten Emilsen, Oslo (NO); Svein Bekken, Langesund (NO); Roger Abrahamsen, Oslo (NO)

(73) Assignee: Yara International ASA, Oslo (NO)

( * ) Notice: Subject to any disclaimer, the term of this patent is extended or adjusted under 35 U.S.C. 154(b) by 982 days.

(21) Appl. No.: 10/571,852

(22) PCT Filed: Sep. 24, 2004

(86) PCT No.: PCT/NO2004/000283

§ 371 (c)(1),
(2), (4) Date: Sep. 21, 2006

(87) PCT Pub. No.: WO2005/030377

PCT Pub. Date: Apr. 7, 2005

(65) Prior Publication Data

US 2007/0040288 A1 Feb. 22, 2007

(30) Foreign Application Priority Data

Sep. 26, 2003 (NO) ..... 20034330

(51) Int. Cl.
*B01F 3/04*

(2006.01)

(52) U.S. Cl. ..... 261/76; 261/116; 261/121.1

(58) Field of Classification Search ..... 261/36.1, 261/76, 77, 115, 116, 121.1, DIG. 7, DIG. 75
See application file for complete search history.

(56) References Cited

U.S. PATENT DOCUMENTS

| | | | | | |
|---|---|---|---|---|---|
| 118,472 | A | * | 8/1871 | Munzinger | 417/77 |
| 2,020,850 | A | * | 11/1935 | Myhren et al | 261/76 |
| 4,207,180 | A | * | 6/1980 | Chang | 210/612 |
| 4,211,733 | A | * | 7/1980 | Chang | 261/36.1 |
| 4,735,750 | A | | 4/1988 | Damann | |
| 4,834,343 | A | * | 5/1989 | Boyes | 261/79.2 |
| 5,154,898 | A | * | 10/1992 | Ajinkya et al. | 422/227 |
| 5,350,543 | A | * | 9/1994 | Spradley | 261/36.1 |
| 5,951,921 | A | * | 9/1999 | Koganezawa et al. | 261/36.1 |
| 5,961,895 | A | * | 10/1999 | Sanford | 261/36.1 |
| 5,968,352 | A | * | 10/1999 | Ditzler | 210/220 |
| 6,036,178 | A | * | 3/2000 | Nilsson | 261/76 |
| 6,199,834 | B1 | * | 3/2001 | Popov et al. | 261/76 |
| 2004/0217068 | A1 | * | 11/2004 | Kirby | 210/760 |

FOREIGN PATENT DOCUMENTS

| | | |
|---|---|---|
| GB | 2 177 618 | 1/1987 |
| SE | 73122434-9 | 4/1975 |
| WO | 81/01700 | 6/1981 |

* cited by examiner

*Primary Examiner*—Scott Bushey
(74) *Attorney, Agent, or Firm*—Wenderoth, Lind & Ponack, L.L.P.

(57) ABSTRACT

A method and an apparatus for mixing of two fluids. The fluid is caused to flow into a mixing chamber (1). The gas is preferably mixed with the fluid before flowing into the mixing chamber. The chamber is vertically oriented and has a mainly cylindrical shape with smooth interior walls. The fluid is led into the chamber via a nozzle (7) in such a way that the fluid flows into the chamber at high velocity. During operation a turbulent gas/liquid phase is formed in the upper part of the chamber and mainly a fluid phase is formed in the lower part of the chamber. The fluid phase with mixed-in gas is drawn off from an outlet (8) arranged at the bottom of the chamber. The mixer could be connected to a transport pipe for fluid.

15 Claims, 4 Drawing Sheets

METHOD AND APPARATUS FOR MIXING OF TWO FLUIDS

BACKGROUND OF THE INVENTION

1. Technical Field

The present invention is related to a method for mixing of two fluids and an apparatus for performing such a method.

The invention is especially related to mixing of water (salt water and/or fresh water) with a gas such as oxygen or carbon dioxide. The use of the invention can be related to water treatment such as treatment of drinking water, wastewater, process water or treatment of water to be used in connection with farming/treatment of aquatic animals. The invention can be used also for process water containing particles or fibers.

2. Description of the Related Art

U.S. Pat. No. 4,210,534 concerns an oxygenation system for supply of oxygen to wastewater. Water and air are supplied to a horizontal mixing chamber respectively by help of a central nozzle and an annular chamber coaxially arranged. The mixing chamber is shaped with tapered converging walls in two stages with a cylindrical shape downstream of this. The mixing chamber has in addition equipment such as a submerged pump, a source of pressurised air, and is collected by a floating construction. The described mixing chamber has a relatively complex geometry, and relatively high production costs must be expected as this structure is either produced by casting or machining. Further, the shape of the mixing chamber with graduate cross sectional area will result in an energy demanding pressure loss.

U.S. Pat. No. 4,735,750 discloses a process and device for the dissolution of gas in liquid. The liquid is introduced under pressure through a nozzle plate into a reaction space, where a mixture of gas and solution flow out through outlets laterally at the bottom into a solution tank and the gas recirculates through inlets at the top near the nozzle plate. The solution tank has a gas cushion and is filled to a level between inlet and outlet at a medium pressure. The dissolved body of gas is delivered subsequently via a gas flow regulator and the solution is drawn off from the solution tank at a low pressure level via a control valve as a supersaturated solution. The device has a complex reactor chamber design and where also level control is necessary. The device is not suitable for aeration of salt water or for fluids containing fibers, as the holes are easily clogged.

Swedish published patent application No. 375 704 describes a vertically arranged device for aeration of water. A nozzle for supply of finely distributed water droplets is arranged in the upper part of the device. The device is filled with water up to a gas cushion below the nozzle. When the droplets hit the surface of the fluid, gas is sucked into the water. The lower part of the device is either submerged in the water to be aerated or the fluid with gas bubbles is led to the water via a pipe. This device is an aerator with low dissolution capacity. It is operated at low pressure. The gas is not dissolved into the fluid, but is maintained as bubbles.

SUMMARY OF THE INVENTION

The object of the invention is to mix and dissolve a gas into a liquid with the highest possible efficiency. Another object is to retain the pressure and create turbulence for internal recirculation of gas. A further object is to obtain a simple design of the mixer with low operation and maintenance costs.

These and other objects of the invention are obtained with the method and device as described below, and the invention is further defined and characterized by the accompanying patent claims.

The invention thus concerns a method and an apparatus for mixing of a fluid and a gas, wherein the fluid is caused to flow into a vertically oriented mixing chamber having mainly a cylindrical shape with smooth interior walls, and where the fluid and gas are fed to the chamber at its upper part. The gas is preferably mixed into the fluid before the mixing chamber and supplied to the chamber by means of a nozzle in such a way that the fluid flows into the chamber at high velocity and fills the chamber. During operation a turbulent gas/liquid phase with internal recirculation is formed in the upper part of the chamber and mainly a fluid phase in the lower part of the chamber and essential pressure loss is avoided in the chamber. A fluid phase with dissolved gas is drawn off from an outlet pipe arranged at the bottom of the chamber.

Preferably the inlet is arranged in such a way that the fluid flows axially into the chamber. The fluid is pumped from a pipeline or reservoir before it is mixed with gas in the mixing chamber and the fluid with dissolved gas is finally supplied back into the pipeline or reservoir. The pressure is released when at least the nozzle of the outlet pipe that is filled with fluid phase with dissolved gas, is submerged in fluid.

The fluid is supplied to the mixing chamber with a pressure of 1.5-10 bar, preferably 2-4 bar, most preferable 3 bar and the pressure in the mixing chamber is maintained at 1.35-9 bar, preferably 1.8-3.6 bar, most preferable 2.7 bar. The fluid could be water with or without a salt content, fibers or particles and the gas is oxygen, carbon dioxide or any dissolvable gas.

The apparatus preferably has a gas injector for supply of gas to the fluid ahead of the mixing chamber. The outlet pipe is adapted to be submerged in liquid and is equipped with a nozzle for supply of liquid with dissolved gas to the ambient fluid. Dimensioning of the nozzle is related to pressure control of the mixing chamber. The mixing chamber is adapted to receive fluid from a pipeline or reservoir via a pump situated between the pipeline and the mixer. Preferably $d1<d3<d2$ wherein d1 is the diameter of the inlet, d2 is the diameter of the mixing chamber and d3 is the diameter of the outlet. It is preferred that the ratio L:d2, where L is the length of the mixing chamber and d2 is the is the diameter of the mixing chamber, is within the interval 15:1 and 20:1.

The present invention has resulted in a vertically oriented mixer, where several of the problems mentioned above can be avoided. The mixer according to the invention has a simple geometry, and will be cheap in production. The mixer does not operate with a gas cushion and thus does not need a gas cushion control device. Further, is has been found that the efficiency of dissolving gas into the fluid is at an acceptable high level.

BRIEF DESCRIPTION OF THE DRAWINGS

The invention will in the following be described further with reference to the figures and examples where.

DETAILED DESCRIPTION OF THE INVENTION

Figure 1:
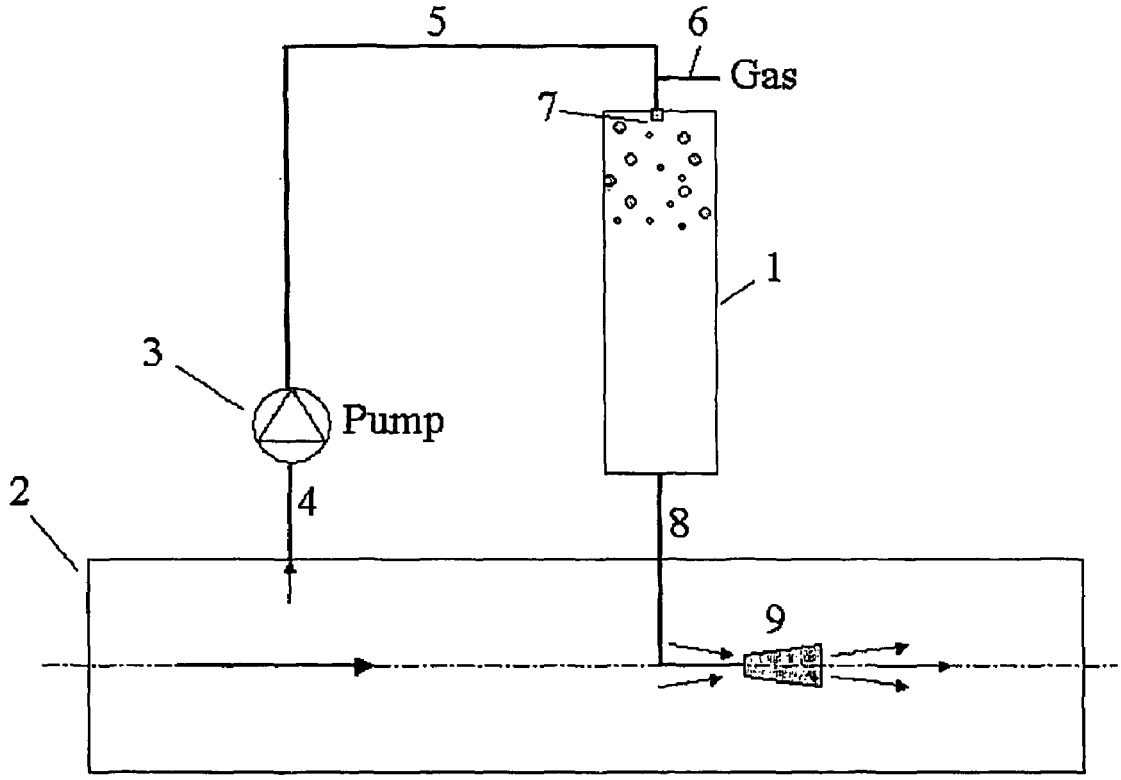
FIG. 1 shows a design of a mixer integrated in to a main water pipe.

As shown in FIG. 1, a mixer 1 is adapted to receive a fluid flow from a pipeline 2, by means of a pump 3 situated between the pipeline and the mixer and further by means of pipelines 4, 5. The fluid can be water (salt water and/or fresh water) or other fluids. The fluid can contain fibers or particles. The pipeline 5 that leads the fluid to the mixer, is further equipped with an injector 6 for gas so that pressurised gas can be supplied to the fluid before being led into the mixer. It is also possible to supply the gas directly into the mixer 1. The gas is in this example carbon dioxide, but the mixer can also handle other types of gas, for example oxygen. The fluid inlet includes in this example a nozzle 7 with a further determined diameter. The function of the nozzle is to supply fluid at a high speed as a jet into the mixer chamber. The fluid is in the example supplied axially into the chamber. From the mixer mixed fluid and gas is led via pipe 8 to an ejector or nozzle 9 that is placed in the pipeline 2. The ejector performs a further mixing of the mixed fluid in the fluid flow in pipeline 2. The ejector can alternatively be placed in a tank, basin or open container.

The Function of the Mixer

Figure 2:
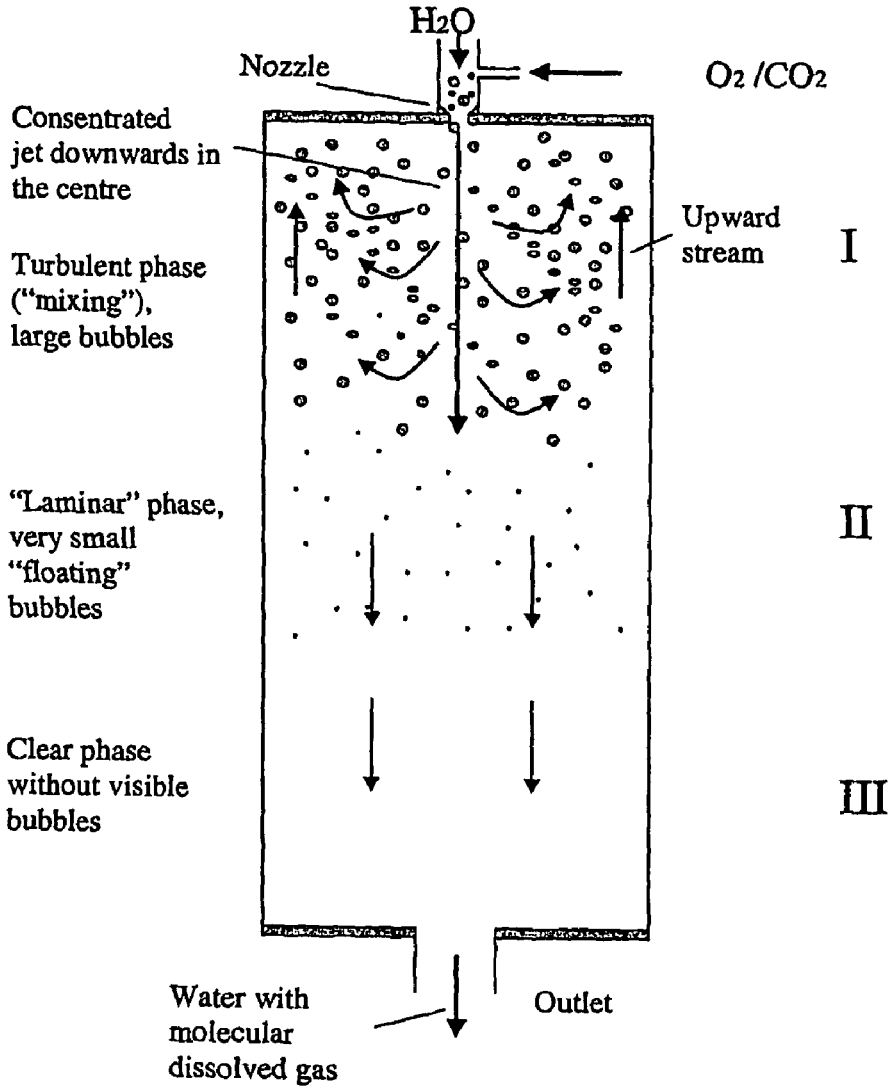
FIG. 2 shows mode of operation and flow pattern in the mixer.

The mixer that can be constituted of a vertical, cylindrical chamber, which is smooth inside, receives fluid mixed with gas at high velocity from the nozzle that is placed in the upper part of the chamber. The mixer is filled with fluid. FIG. 2 illustrates the function and flow pattern in the mixer. A concentrated jet of water and gas is introduced centrally and creates internal recirculation. During operation it mainly will be formed a mixture of gas and fluid in the upper part of the chamber (I), while mainly a fluid phase (with molecular dissolution of gas phase) will occupy the lower part of the chamber. During experiments carried out with a transparent mixer, it was observed a very turbulent bubble phase in the upper part of the chamber, which creates a large contact area and is favorable for the break down of large bubbles. In the middle of the chamber there is a "laminar" phase with very small floating bubbles (II). At the bottom of the chamber (III) it is observed a clear phase without visible bubbles, which means that all gas is dissolved and a fluid saturated with gas is obtained.

During experiments an increasing amount of gas was supplied, and it was observed that the bubble phase takes up an increasing larger part of the chamber, which means it creeps nearer the bottom of the chamber. At maximum load, bubbles start to follow the water out of the mixer.

Experiments have shown that the degree of dissolution of gas in fluid is affected by several conditions. One of the most important is the pressure loss over the mixing chamber, and especially the choice of aperture of the nozzle 6 at the inlet. The design of this aperture will at the same time contribute to the velocity of the jet downwards in the turbulent zone of the mixer.

Figure 3:
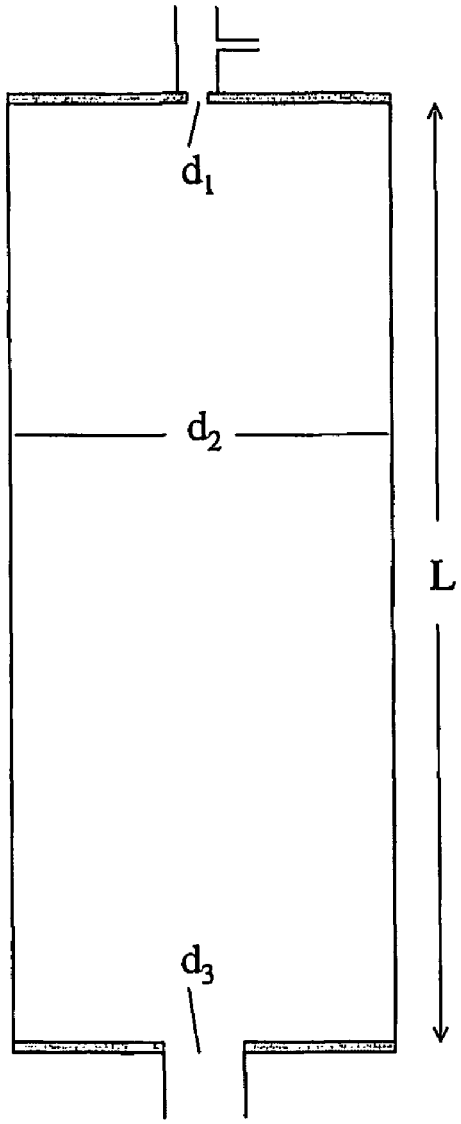
FIG. 3 shows a mixer with given parameters, which is used in experiments.

Table 1 shows results from experiments with different diameters of the nozzle 6. The nozzle consists of a disc with a central aperture. The aperture has some tapering in inlet/outlet to reduce the pressure loss. The mixer used in the experiments has the following measures (ref. FIG. 3): D2: 117 mm, D3: 65 mm, L: 2000 mm. D4 (ref. Table 1) is the diameter of the nozzle (ejector) (9) in the main pipe (after mixer).

TABLE 1

Results from tests with $CO_2$ and fresh water

| # | Nozzle d1 [mm] | Ejector d4 [mm] | Q water [l/h] | P before nozzle [bar] | P after nozzle [bar] | Amount dissloved $CO_2$ [g/l] |
|---|---|---|---|---|---|---|
| 1 | 12 | 11.0 | 4100 | 2.0 | 1.10 | 2.0 |
| 2 | " | " | 5200 | 3.0 | 1.63 | 3.1 |
| 3 | " | " | 6000 | 4.0 | 2.25 | N.A. |
| 4 | 16.5 | " | 7020 | 3.0 | 2.45 | N.A. |
| 5 | 18.0 | " | 7200 | 3.0 | 2.55 | 3.5 |
| 6 | 18.0 | 10.0 | 5800 | 3.0 | 2.7 | 4.0 |

N.A. (not analysed)

By means of the results given in Table 1, the optimum ratio between nozzle aperture (mixer) and ejector aperture (main pipe etc.) is chosen.

The following results are obtained from tests carried out with oxygen and fresh water. The total pressure loss in the described example will among others be influenced by the design, of the ejector or nozzle 9 and the diameter and height of the mixing chamber.

FIG. 3 shows a mixer with given parameters that was used in the experiments. Further parameters are provided in Table 2 below:

TABLE 2

| $d_1$ [mm] | $d_2$ [mm] | $d_3$ [mm] | L [mm] | $Q_{water}$ [l/min] | $T_{water}$ [° C.] | $P_{mixser}$ [barg] | Raw water O2 [mg/l] |
|---|---|---|---|---|---|---|---|
| 18 | 117 | 65 | 2000 | 97 | 5.6 | 3.0 | 12.4 |

TABLE 3 shows an extract of the results from the test.

| | | | | | | | | | | |
|---|---|---|---|---|---|---|---|---|---|---|
| $O_2$ supplied [mg/l] | 53.8 | 72.4 | 78.3 | 84.3 | 90.4 | 96.6 | 103.7 | 110.9 | 117.8 | 124.7 |
| Extension of bubble phase [part of the length of the mixer] | 0.28 | 0.33 | 0.38 | 0.44 | 0.49 | 0.54 | 0.62 | 0.72 | 0.82 | 0.92* |

*Extension of bubble phase = 1.0 means that the mixer is filled with bubbles. It has reached the limit for the capacity and gas that is not dissloved follows the water as bubbles out of the mixer.

Figure 4:
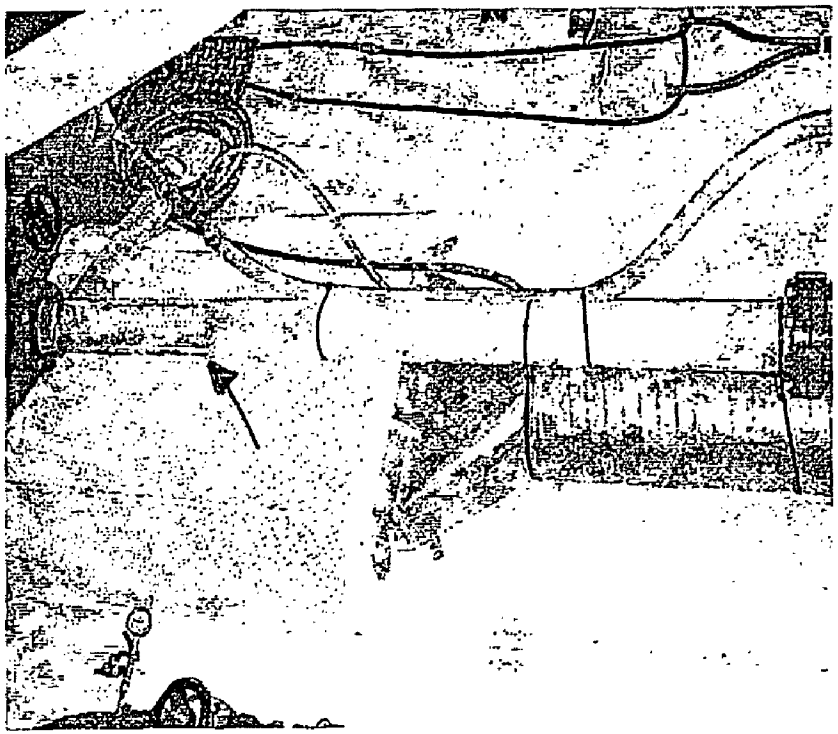
FIG. 4 shows a photo of a mixer during experiments with oxygen and fresh water.

FIG. 4 shows a photo of a mixer during experiments with oxygen and fresh water, and a clear division (marked with an arrow) between gas phase and fluid phase in the mixer is shown.

The invention claimed is:

1. A method of mixing a fluid and a gas, the method comprising:

injecting the gas into the fluid;

feeding a flow of the fluid and gas into an upper part of a vertically oriented mixing chamber having mainly a cylindrical shape with smooth interior walls, wherein the fluid and gas are fed into the mixing chamber at a pressure of 1.5-10 bar by means of an inlet nozzle in such a way that the fluid and gas flow into the mixing chamber at high velocity and fill the mixing chamber, wherein the flow of the fluid and gas into the mixing chamber forms a turbulent gas/fluid phase with internal recirculation in the upper part of the mixing chamber and mainly a fluid phase in a lower part of the mixing chamber;

maintaining the pressure in the mixing chamber at 1.35-9 bar to avoid essential pressure loss in the mixing chamber; and drawing off the fluid phase with dissolved gas from an outlet pipe arranged at a bottom of the mixing chamber, wherein the outlet pipe has an outlet nozzle and at least the outlet nozzle is submerged in fluid where the pressure is released.

2. The method according to claim 1, wherein the inlet nozzle is arranged in such a way that the fluid flows axially into the chamber.

3. The method according to claim 1, wherein the fluid is pumped from a pipeline or reservoir before being mixed with the gas, and the fluid phase with dissolved gas is supplied back into the pipeline or reservoir via the outlet nozzle.

4. The method according to claim 1, wherein the fluid and gas are supplied to the mixing chamber at a pressure of 2-4 bar.

5. The method according to claim 4, wherein the fluid and gas are supplied to the mixing chamber at a pressure of 3 bar.

6. The method according to claim 1, wherein the pressure in the mixing chamber is maintained at 1.8-3.6 bar.

7. The method according to claim 6, wherein the pressure in the mixing chamber is maintained at 2.7 bar.

8. The method according to claim 1, wherein the fluid is water and the gas is a dissolvable gas.

9. The method according to claim 8, wherein the water includes a salt, fibers or particles, and the gas is oxygen or carbon dioxide.

10. An apparatus for mixing and dissolving a gas into a fluid, the apparatus comprising:

a pipeline or reservoir for containing a fluid;

a pump connected to the pipeline or reservoir;

a gas inlet for injecting gas into the fluid pumped by the pump from the pipeline or reservoir;

a vertically-oriented mixing chamber having an inlet formed in an upper part of the mixing chamber, the inlet being connected to the pump for receiving fluid from the pipeline or reservoir, wherein the inlet comprises a nozzle for supplying the fluid containing gas to the mixing chamber at high velocity; and an outlet pipe arranged at a bottom of the mixing chamber for drawing off a fluid phase comprising dissolved gas from the mixing chamber, the outlet pipe being provided with an outlet nozzle disposed in the pipeline or reservoir for supplying the fluid with gas dissolved therein to fluid in the pipeline or reservoir.

11. An apparatus according to claim 10, further comprising a gas injector for supply gas to the fluid upstream of the mixing chamber.

12. An apparatus according to claim 10, wherein $d1<d3<d2$, where d1 is the diameter of the inlet, d2 is the diameter of the mixing chamber and d3 is the diameter of the outlet.

13. An apparatus according to claim 10, wherein the ratio L:d2 is within a range of 15:1 to 20:1, where L is the length of the mixing chamber and d2 is the diameter of the mixing chamber.

14. An apparatus for mixing and dissolving a gas into a fluid, the apparatus comprising:

a mixing chamber that is vertically oriented and has a mainly cylindrical shape with smooth interior walls, the mixing chamber comprising an inlet for fluid and an inlet for gas, the inlet comprising a nozzle disposed in an upper part of the mixing chamber for supplying fluid containing gas to the mixing chamber at high velocity, wherein under operation a turbulent gas/liquid phase is formed in the upper part of the mixing chamber and mainly a fluid phase is formed in a lower part of the mixing chamber; and an outlet pipe arranged at an outlet formed in a bottom of the mixing chamber, wherein a fluid phase comprising mixed in gas can be drawn off from the mixing chamber through the outlet pipe, wherein $d1<d3<d2$, where d1 is the diameter of the inlet, d2 is the diameter of the mixing chamber and d3 is the diameter of the outlet.

15. An apparatus according to claim 14, wherein a ratio L:d2 is within a range of 15:1 to 20:1, where L is the length of the mixing chamber.

* * * * *